United States Patent [19]

Roesch

[11] 4,314,598

[45] Feb. 9, 1982

[54] INTEGRAL WINDOW UNITS

[75] Inventor: Edgar B. Roesch, Pennington, N.J.

[73] Assignee: The Roesch Trust, Bristol, Pa.

[21] Appl. No.: 848,892

[22] Filed: Nov. 7, 1977

Related U.S. Application Data

[63] Continuation of Ser. No. 726,265, Sep. 24, 1976, abandoned.

[51] Int. Cl.[3] ..... E06B 3/32; A47H 1/00; E05B 65/04; E05C 7/02

[52] U.S. Cl. ..... 160/90; 49/63; 49/DIG. 1; 160/91; 160/92

[58] Field of Search ..... 160/90–92; 49/63, 181, 421, DIG. 1, 428, 414, 445

[56] References Cited

U.S. PATENT DOCUMENTS

| | | | |
|---|---|---|---|
| 1,010,700 | 12/1911 | Steger | 49/428 |
| 2,357,119 | 8/1944 | Kirkpatrick | 160/90 |
| 3,239,976 | 3/1966 | Hall | 160/90 |
| 3,416,260 | 12/1968 | Johnson | 49/414 |
| 3,464,157 | 9/1969 | Rodriguez | 49/181 |
| 3,534,800 | 10/1970 | Guttman | 160/92 |
| 3,587,705 | 6/1971 | Zappone | 160/91 |
| 3,861,082 | 1/1975 | Dau | 49/181 |
| 3,908,730 | 9/1975 | Goss, Jr. et al. | 160/90 |

*Primary Examiner*—C. J. Husar
*Assistant Examiner*—C. S. Lieberman
*Attorney, Agent, or Firm*—John W. Logan, Jr.

[57] ABSTRACT

An integral window unit comprising a sill member, a header member and a pair of jamb members interconnected to form a generally rectangular window frame. The jamb members have first and second pairs of track means each pair of which slideably receives a prime window sash and third and fourth pairs of track means each pair of which slideably receives a storm window sash. The distance between the track members in the first pair is greater than the distance between the track members in the second pair which in turn is greater than the distance between the third pair which is greater than the distance between the fourth pair. At least one pair of track means is in overlapping relationship with the adjacent pair of track means. A thermal barrier is provided in the window frame between the second and third pair of track members to minimize heat loss therethrough and a fifth pair of track means is provided adjacent the thermal barrier for slideably receiving a screen member.

10 Claims, 11 Drawing Figures

FIG. 9.
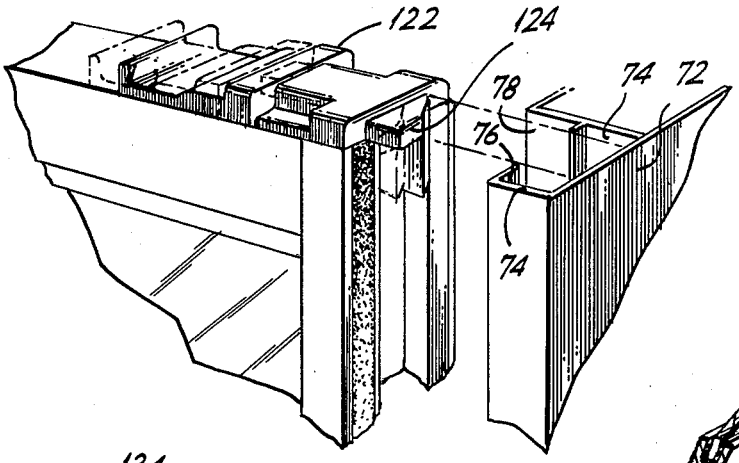
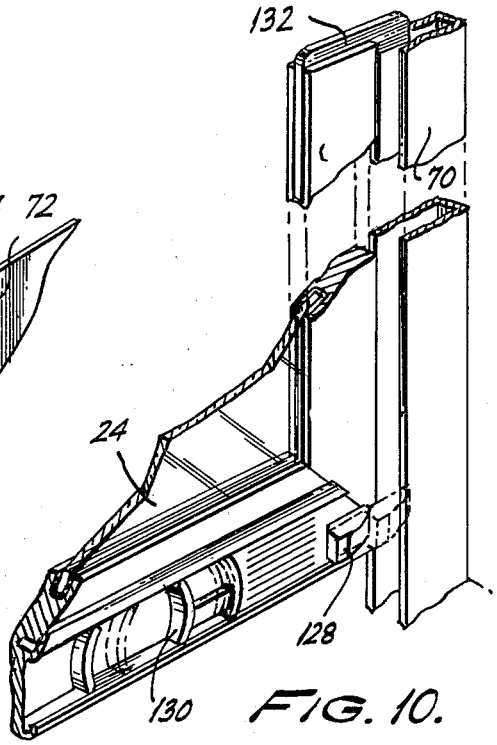
FIG. 10.
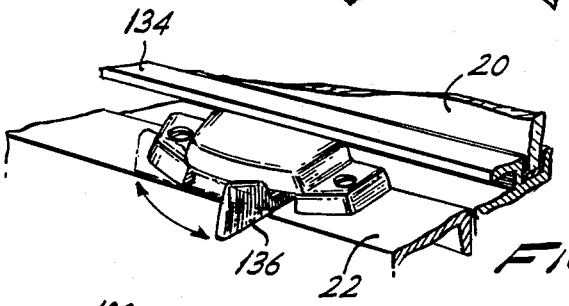
FIG. 11.
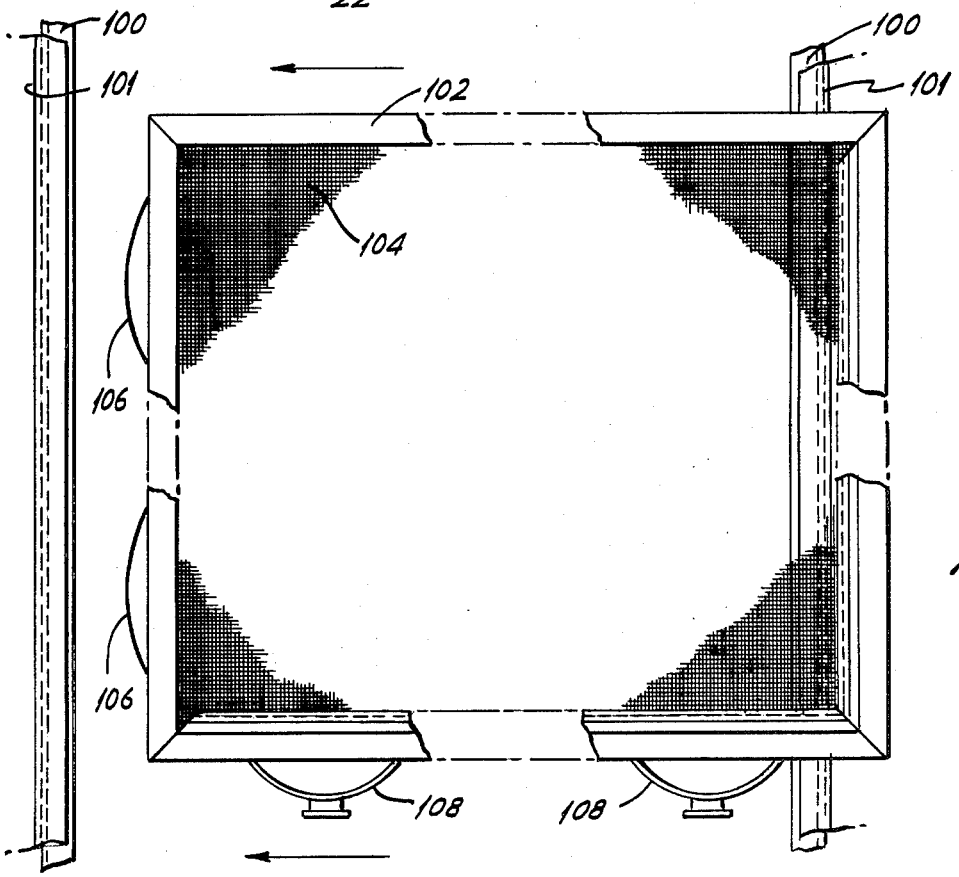
FIG. 6.

INTEGRAL WINDOW UNITS

This is a continuation, of application Ser. No. 726,265, filed Sept. 24, 1976, now abandoned.

This invention relates to window frames and more particularly to an integral window frame arranged to receive both prime and storm windows and also a screen member so that a complete window is provided.

In the building industry it is usual to install storm windows in addition to the usual prime windows to provide additional insulation and cut heat loss through the window openings. When installing new window units it is usual to first install the prime window frame and sashes and if, as is common, the window unit is made of metal, to secure a thermal barrier around the periphery of the outer surface of the prime window frame. Afterwards, the storm window frame and sashes are secured to the prime frame such that the thermal barrier is located between the prime and storm window frames. In this way, a direct heat conductive path is eliminated. As should be clear, the above-explained approach is relatively expensive requiring the expense of manufacturing two distinct window units and the expense of installing two distinct window units plus a thermal barrier in each window opening. The use of two distinct window units and the attendant expense is necessitated because of space limitations imposed by the window opening on the depth of a window frame. The depth of a conventional window frame is on the order of about three and one-quarter ($3\frac{1}{4}$) inches and it has not been feasible to provide the four pairs of tracks and four window sashes, two prime sashes and two storm sashes, within the narrow depth of conventional window frames.

Accordingly, it is an object of this invention to provide an integral window unit including both prime and storm window assemblies.

It is another object of this invention to provide an integral window frame made of metal and including a relatively rigid thermal barrier between a prime window track portion and a storm window track portion.

It is yet another object of this invention to provide an integral window unit including both prime and storm window assemblies and a screen member within a window frame having a relatively narrow depth.

Finally, it is an object of this invention to provide an integral storm and prime window unit that is economical and easy to install.

These and other objects of this invention are accomplished by providing a sill member, a header member and a pair of jamb members interconnected to provide a generally rectangular window frame. Also provided are first, second, third and fourth pairs of track means, each track means in a pair being formed in a different jamb member so that the first and second pair each slideably receive a prime window sash and so that the third and fourth pair each slideably receive a storm window sash. Each track means in a pair is offset from the track means in an adjacent pair.

More particularly, the track means are arranged so that the track means in the first pair are spaced farther apart than the track means in the second pair which are spaced farther apart than the track means in the third pair which are spaced farther apart than the track means in the fourth pair. At least some of the track members in adjacent pairs including a wall extending along the depth of the jamb member and being in overlapping relationship. In addition, a fifth pair of track means is located intermediate the second and third track means and inwardly adjacent a thermal barrier extending around said window frame also located intermediate the second and third pair of track means. Each track means in the fifth pair is in a different jamb member so that the fifth pair slideably receives a screen member.

Counterbalance spring means are provided for the prime window sashes and all of the window sashes and the screen member are all arranged to be removable.

For a better understanding of the invention, reference is made to the following description of a preferred embodiment thereof, taken in conjunction with the figures of the accompanying drawing, in which:

FIG. 6 is a front elevation view of a screen that can be utilized in accordance with this invention;

FIG. 9 is a perspective view illustrating the guide means shown in FIG. 7 assembled to a prime window;

FIG. 10 is a perspective view of a latch means utilized with the storm windows in accordance with this invention; and, FIG. 11 is a perspective view of a window lock that can be utilized in accordance with this invention.

Figure 1:
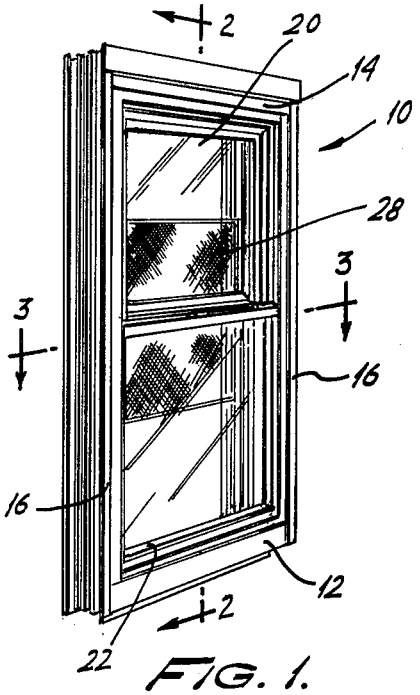
FIG. 1 is a perspective view of a window unit in accordance with this invention.

Referring first to FIGS. 1–4, there is illustrated an integral window unit 10 in accordance with this invention. Included in the window unit is a window frame including a sill 12, a header 14 and a pair of jambs 16,16 rigidly interconnected to form a generally rectangular window frame. All of these noted components in the frame are made of extruded aluminum or similar material. The window frame is arranged to carry upper and lower prime window sashes 20 and 22, respectively, upper and lower storm window sashes 24 and 26, respectively, and a screen member 28. The window sashes are arranged as will be explained hereinafter, such that the prime window sashes 20 and 22 and the storm window sashes 24 and 26 are adjacent each other in face-to-face relationship to provide an insulating air space. Between the prime window sashes and storm window sashes the frame is provided with a thermal barrier 30 which obviates a heat conducting path through the window frame. The thermal barrier 30 is preferably an epoxy resin which may include reinforcing fiberglass or may be any other suitable thermal insulating material. In addition the material comprising the thermal barrier 30 is relatively rigid so that the sill 12, header 14 and jambs 16 and 18 can be made in accordance with the Nilsen U.S. Pat. No. 3,204,324, that is, the various components of the frame can be extruded with a suitable interlocking channel-like configuration 32 with a spanning wall extending across the channel. The channel includes interlocking fingers 34 and is filled with the epoxy resin material which is in a liquid form. After the resin hardens, the spanning wall is removed by a cutting technique so that metal-to-metal contact across the channel is avoided, but the frame is an integral relatively rigid configuration.

Figure 2:
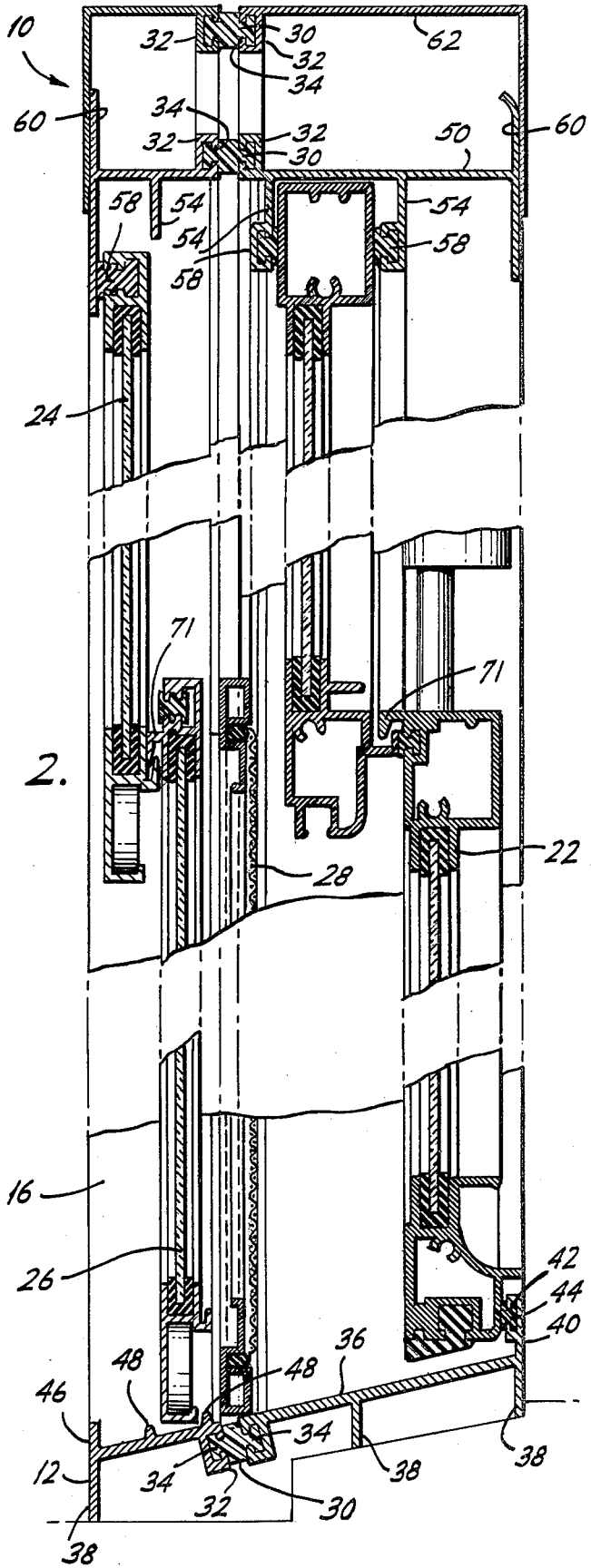
FIG. 2 is a generally vertical section view of the window unit illustrated in FIG. 1 and taken generally along the line 2—2 thereof.
Figure 7:
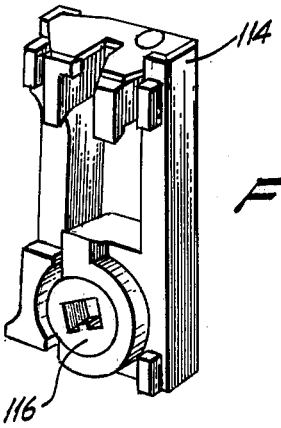
FIG. 7 is a perspective view of a guide member utilized with the prime windows in accordance with this invention.

Referring now particularly to FIG. 2 of the drawing, the sill 12 is clearly illustrated in cross-section and can be seen to include an inclined base portion 36 and a plurality of stiffening ribs 38 extending downwardly from the base portion. Extending upwardly from the base portion 36 at the inner end thereof is an upstanding guide member 40 which is used to guide the lower prime window sash 22 into position on the sill when that window sash is closed. The guide member 40 extends across the sill member 12 and includes a channel configuration 42 in which a strip of felt 44, plastic or similar material is located to prevent metal-to-metal contact with the sash and to act as a weatherstrip. At the outer end of the sill member 12 and extending thereacross is another guide member 46 and spaced inwardly therefrom is another pair of guide members 48,48. The guide members 46 and the adjacent guide member 48 guide the upper storm window sash 24 when it is lowered and the guide members 48,48 function to guide the lower storm window sash 26 when it is lowered. The thermal barrier 30, channel 32 and interlocking fingers 34 are clearly illustrated.

Still referring to FIG. 2 of the drawing, the header 14 can be seen to include a generally flat base portion 50 which provides the upper stop surface for the upper prime sash 20 and the upper storm sash 24 when those sashes are in their closed position and the lower storm sash 26 when it is in its open position. Projecting downwardly from the base portion are stiffening members 52 located at the ends of the base portion and three guide members 54 located intermediate the stiffening members 52. The outermost stiffening member 52 and the adjacent guide member 54 guides the upper storm sash 24 as it moves to its closed position and the storm sash 24 carries a strip of felt 58, plastic or similar material to prevent metal-to-metal contact and to function as a weatherstrip. When the lower storm sash 26 is raised, of course, it is guided by the outermost guide member 54. The innermost pair of guide members 54,54 guide the upper prime window sash 20 when it is in its closed position and adjacent surfaces of the innermost pair of guide members 54,54 also have felt, plastic or similar strips 58,58 preventing metal-to-metal contact and acting as a weatherstrip. Extending upwardly from each of the stiffening members 52,52 are tapered guide members 60,60 which are received in a U-shaped expander 62. The thermal barrier 30, channel 32 and interlocking fingers 34 formed on the header can be seen and can also be seen on the expander 62.

Figure 3:
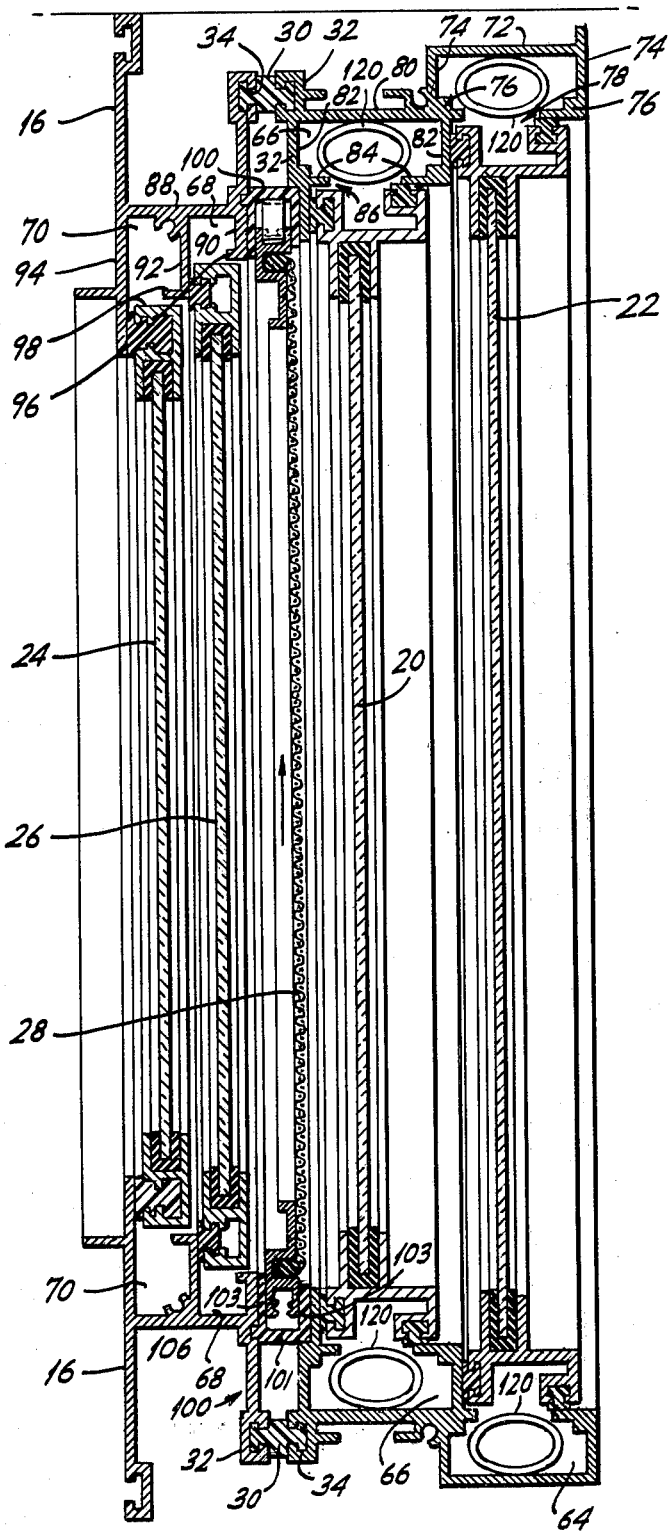
FIG. 3 is a generally horizontal sectional view of the window unit illustrated in FIG. 1 and taken generally along the line 3—3 thereof.

Referring now particularly to FIG. 3, the jambs 16,16 are clearly illustrated in cross-section as is the arrangement in accordance with this invention for locating both prime windows and the storm windows and a screen member in the relatively shallow depth of the window opening. Formed in the jambs 16,16 are first, second, third and fourth pairs of track means 64,66 and 68 and 70, respectively. One track means in each pair is located in a different jamb 16 and are otherwise so arranged that the first pair 64 slideably receives the lower prime sash 22, the second pair 66 slideably receives the upper prime sash 20, the third pair 68 receives the lower storm sash 26 and the fourth pair 70 receives the upper storm sash 24. Each of the track means in an adjacent pair are spaced apart along the depth of the jambs 16,16, that is, along the distance from the inner end to the outer end, so that the first pair 64 are located at the inner end, the second pair 66 is outwardly adjacent the first pair 64, but are relatively close thereto so that when the prime sashes 20,22 are closed, they are in abutting relationship as shown in FIG. 2 of the drawing. The fourth pair 70 are adjacent the outer end of the jambs and the third pair 68 is inwardly adjacent the fourth pair and, of course, outwardly adjacent the second pair 66. The third pair 68 and the fourth pair 70 are relatively close to each other so that when the storm sashes 24 and 26 are closed, they too are in abutting relationship as shown in FIG. 2 of the drawing. Still referring to FIG. 2 of the drawing it can be seen that when the sashes 20, 22, 24 and 26 are closed the abutting relationship is by means of an interlocking finger configuration 71. Referring back to FIG. 3 of the drawing it can be seen that the thermal barrier 30, channel 32 and interlocking fingers 34 are located between the second pair 66 and third pair 68 of track means so that a continuous heat conductive path is not provided between the prime and storm window portions of the window.

As clearly seen in FIG. 3 of the drawing each track means in a pair is offset from the track means in an adjacent pair so that the prime and storm windows fit in the relatively small depth of the jambs 16,16. Preferably, the distance between the track means in each pair decreases from the first pair 64 to the fourth pair 70 and wherein the track means in one pair are in overlapping relationship with the track means in an adjacent pair along the depth of the jambs 16,16. Thus, the distance between track means 64,64 is greater than the distance between track means 66,66 which distance is greater than the distance between track means 68,68 which distance is greater than the distance between track means 70,70. Accordingly, the width of the sashes progressively decreases from the inner to the outer end of the jambs. In addition to aiding in fitting the track means and sashes in the relatively narrow depth of the jambs 16,16, the progressive decrease in the width of the sashes allows the sashes to be so arranged that they can be pivoted downwardly and inwardly, as illustrated by the position of sash 22 in FIG. 4 of the drawing. Such pivotal movement facilitates cleaning the glass carried in the sashes.

Each of the track means in a pair is of the same general configuration and each is generally rectangular in cross-section with an opening to form guide channels. Thus, the track means 64,64 each includes an outer wall portion 72 extending parallel to or along the depth of the jamb 16, a pair of shorter wall portions 74,74 extending parallel to the sill 12 and header 14 and a pair of short inner walls 76,76 projecting toward each other to form an opening 78 in which guide members on the lower prime sash 22 are received as will be fully explained hereinafter. Similarly, the track means 66,66 each includes an outer wall portion 80 extending parallel to or along the depth of the jamb 16. The wall portion 80 extends from the adjacent short wall 76 on the adjacent track means 64. Also included are a pair of shorter wall portions 82,82 extending parallel to the sill 12 and header 14 and another pair of short inner wall portions 84,84 extending toward each other to form an opening 86 in which guide members on the upper prime sash 20 are received. The short wall 82 adjacent the track means 64 is located inwardly of the short wall portion 74 adjacent the track means 66 so that the track means 64 and 66 are in slight overlapping relationship. With this overlapping arrangement of the track means 64 and 66 the four pairs of track means 64, 66, 68 and 70 can be accomodated in the small depth of the jambs 16,16.

The track means 68 and 70 are formed with a common wall 88 extending along the depth of the jambs 16. From the wall 88 there extends a short wall 90, a longer wall 92, and a still longer wall 94, all of these wall extend parallel to the sill 12 and header 14. A short wall 96 extends from the end of the wall 92 toward the wall 94. Accordingly a guide channel is formed between walls 90 and 92 for guide members on the lower storm sash 26 and also between walls 92 and 94 for guide members on the upper storm sash 24.

The channels 32 for the thermal barrier 30 are formed on the outside of track means 64 and 66 as clearly illustrated in FIG. 3 of the drawing. Inwardly adjacent the channels 32 is a fifth pair of track members 100 for the screen member 28. Each of the track means 100 is a generally U-shaped vinyl member comprising a back wall 101 and a pair of parallel walls 103 carried between wall 90 of the third pair of track means 68 and adjacent wall 82 of the second pair of track means 66. The distance between each of the track means in the fifth pair 100 is greater than the distance between the track means 68, but less than that between track means 66 so that the screen member 28 can be inserted and removed from the window unit.

Figure 4:
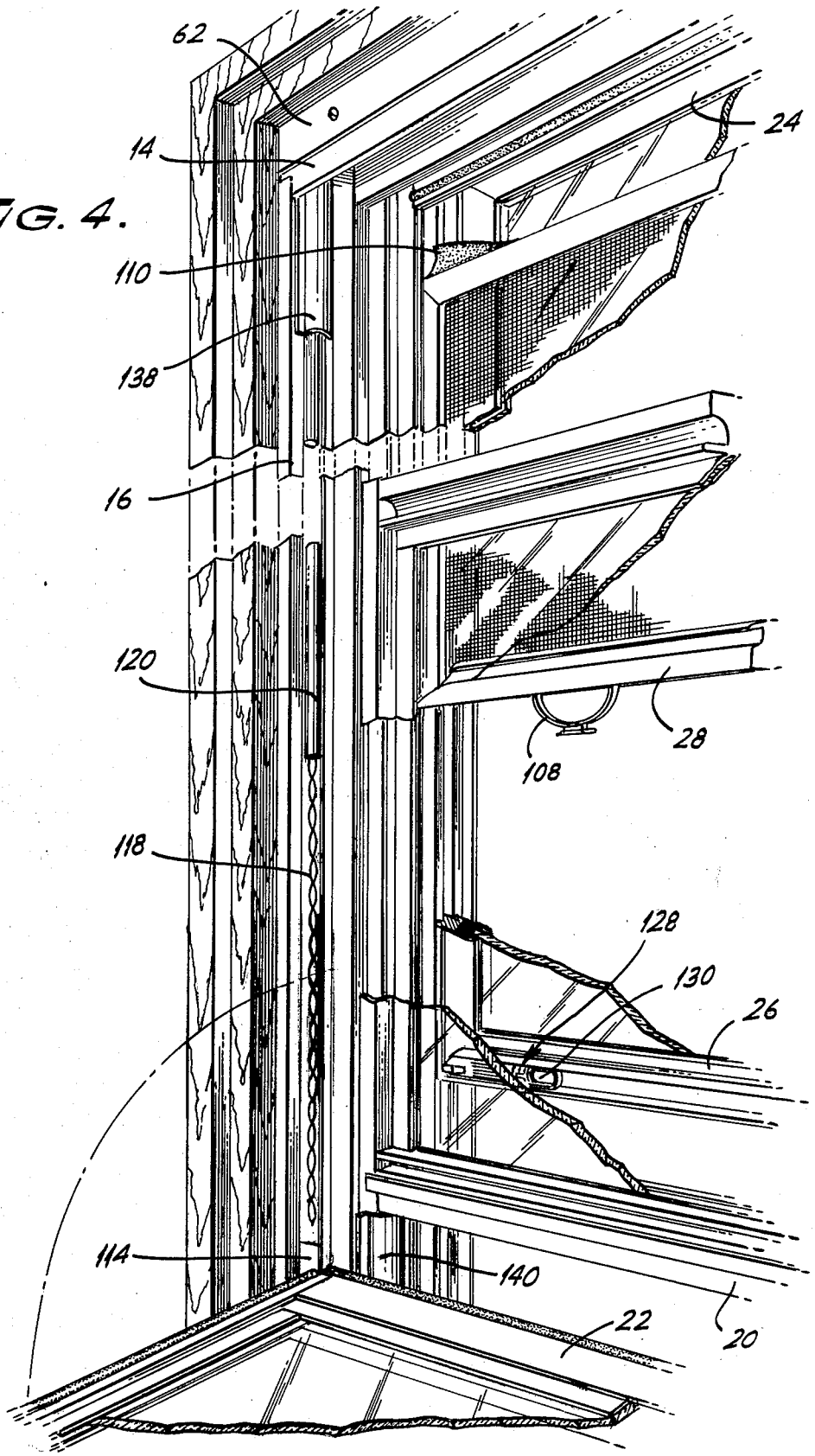
FIG. 4 is an enlarged perspective view of a portion of the window illustrated in FIG. 1.

Referring particularly to FIGS. 3 and 6 of the drawing it can be seen that the screen member 28 includes a generally rectangular frame 102 in which a mesh screen 104 is carried. The width of the frame 102 is slightly less than the distance between back walls 101 of the U-shaped members so that while the screen member 28 is slideably carried between the track means it is shiftable to a position wherein one vertical frame member bears against the back wall 101 of one of the U-shaped members and the other vertical frame member is not seated between the parallel walls 103 of the other U-shaped member. Thus the screen member 28 can be pivoted about a vertical axis and removed. To keep the screen member 28 in the U-shaped members, one vertical frame member carries a plurality of bowed leaf springs 106,106 which bias the screen member into position therein, but which are slideably mounted whereby they can be compressed when a force is applied to the screen member 28 to move it to the position noted above permitting its removal. Installation of the screen member 28 is accomplished by inserting the vertical frame member with the springs 106,106 into a U-shaped member, and exerting a force so that the inserted vertical frame member compresses the springs 106,106 and bears against the back wall 101. The screen member 28 is now pivoted until the other vertical frame member is aligned with the other U-shaped member and the force is released allowing the spring members 106,106 to bias the screen member into position. The screen member 28 can be provided with suitable plastic handles 108,108 to facilitate sliding it in the track means 100 and also with a rubber flap 110, as best seen in FIG. 4 of the drawing, which keeps insects from passing into the building when the lower prime sash 24 is open and the screen member is closed.

Figure 5:
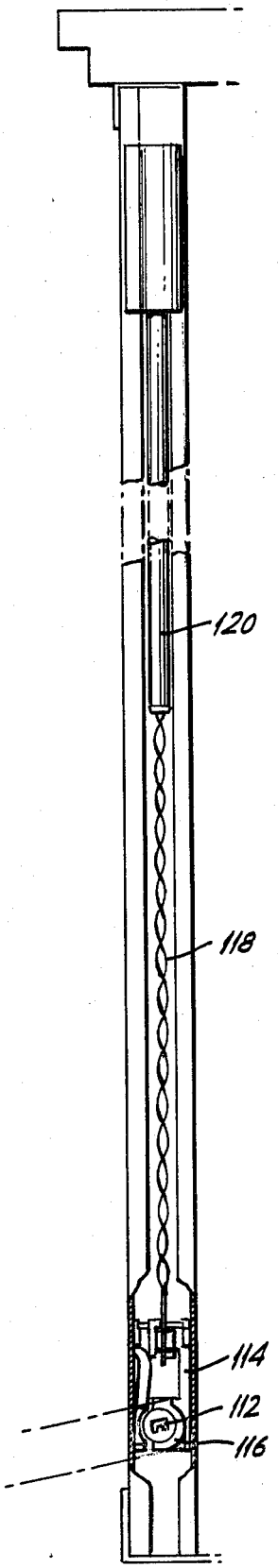
FIG. 5 is a side elevation view illustrating a counterbalance means which can be utilized with the prime windows in accordance with this invention.

Each of the prime sashes 20 and 22 are provided with mounting arrangements and such mounting arrangements are provided at each side of each sash. Accordingly only one mounting arrangement will be described it being understood that all arrangements are exactly the same. Referring to FIGS. 4 and 5, the lower end of the prime sash includes a guide pin member 112 projecting into the opening 78 formed in the track means 64 and the pin member is received in a slider member 114. The slider member 114 is preferably a nylon member fitting into the guide channels formed by the wall portions 72,72, 74 and 76,76. Adjacent its lower end the slider member 114 includes a rotatable plug 116 having an opening in which the guide pin member 112 is received to provide the pivoting motion explained previously. The top of the slider member 114 is connected to a spiral rod 118 received in a spring housing 120 of a conventional spiral balance means which acts as a counterbalance for the sash. As is conventional sliding movement of the lower prime sash 22 moves the slider members 114, in turn, moving the spiral rod 118 and actuating a spring member in the housing 120.

Figure 8:
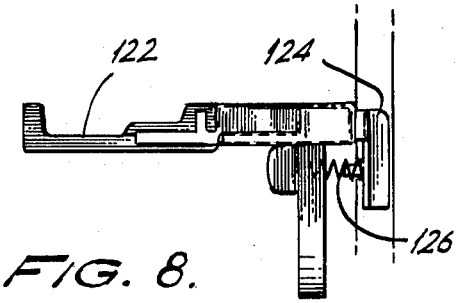
FIG. 8 is a side elevation view of a sash lock utilized with the prime windows in accordance with this invention.

Referring to FIGS. 8 and 9 of the drawing a sash lock member 122 used at each side of the sash member 22 and at the upper end thereof is illustrated. The sash lock member 122 includes a generally L-shaped body member adapted to fit on the corner of the sash. Slideably carried through the body member is a finger 124 which is normally urged by a spring 126 into the guide channel formed by the wall portion 72, 74,74, 76 and 76. When so arranged within the guide channel the sash is retained for sliding movement; by retracting the finger 124 by pushing against the spring 126, the sash can be pivoted to the position illustrated in FIG. 4 of the drawing.

Each of the storm sashes 24 and 26 are provided with generally conventional mounting arrangements and such mounting arrangements are provided at each side of each sash. Accordingly, only one mounting arrangement will be described it being understood that all arrangements are exactly the same. Referring to FIG. 10 of the drawing the mounting arrangement on one side of the upper storm sash 24 is shown and includes a spring loaded guide finger 128 at the bottom of the sash which is normally in the guide channel of track means 70. By exerting a force on the gripping portion 130, the finger member 128 is withdrawn from the guide channel so that the upper storm sash 24 can be pivoted about the fixed guide finger 132 at the top of the sash to remove the sash or clean the window.

At this point it is noted that all of the sashes are generally conventional and the prime window sashes include a lock means including a lip 134 formed at the bottom of the upper prime sash 20 and a pivoted cam member 136 on the lower prime sash 33. When the cam member 136 is pivoted into position under the lip 134, the prime sashes are locked against movement. In addition, the track means 64, 64 include a plastic stop member 138 at its top end and the track means 66,66 include a similar plastic stop member 140 at its lower end. The stop members 138 and 140 act to limit the movement of the prime sashes 22 and 20, respectively.

While in the foregoing there has been described a preferred embodiment of the invention it should be understood that various changes and modifications can be made without departing from the true spirit and scope of the invention as recited in the appended claims.

I claim:

1. An integral window unit comprising a sill member, a header member and a pair of jamb members interconnected to form a generally rectangular window frame, first, second, third and fourth pairs of track means, one track means in each pair being located in one of said jamb members so that the first and second pair of track means each slideably receive a prime window sash and so that the third and fourth pair of track means each slideably receive a storm window sash, each track means in a pair being offset from the track means in an adjacent pair whereby removal of said window sashes is facilitated, each track means in said first and said second pairs of track means including an outer wall portion and first and second spaced-apart inner wall portions extending parallel to the depth of said jamb members, each track means in said first pair of track means further including a first short wall portion spaced from said second track means and a second short wall portion adjacent said second track means, each track means in said second pair of track means including a third short wall portion adjacent said first track means and a fourth short wall portion spaced from said first track means, said short wall portions extending transverse to said inner and outer wall portions whereby said each track means in said first and second pair of track means is generally rectangular in cross-section, said outer wall portion in each track means in said second pair of track means lying in a common plane with the adjacent inner wall portion of said first pair of track means, said third short wall portion being closer to said first short wall portion than is said second wall portion and said second wall portion being closer to said fourth wall portion than is said third wall portion whereby said first pair of track means is in overlapping relationship with said second pair of track means along the depth of said jamb members.

2. An integral window unit in accordance with claim 1 wherein the distance between the track means in each pair of track means progressively decreases from the first pair to the fourth pair.

3. An integral window unit in accordance with claim 1 wherein said track means in said first pair are spaced farther apart than said track means in said second pair which are spaced farther apart than said track means in said third pair which are spaced farther apart than said track means in said fourth pair.

4. An integral window unit in accordance with claim 1 including a fifth pair of track means intermediate said second and third pair of track means, each track means in said fifth pair being located in a different jamb member so that said fifth pair of track means slideably receives a screen member.

5. An integral window unit in accordance with claim 1 including a relatively rigid thermal barrier extending about said window frame between said second and third pair of track means.

6. An integral window unit in accordance with claim 5 including a fifth pair of track means inwardly adjacent said thermal barrier, each track means in said fifth pair being located in a different jamb member so that said fifth pair of track means slideably receives a screen member.

7. An integral window unit in accordance with claim 6 wherein said each track means in said fifth pair is made of a material also acting as a thermal barrier.

8. An integral window unit in accordance with claim 4 wherein each of said track means in said fifth pair comprises a generally U-shaped member including a cross-leg member, said cross leg members facing each other and being spaced apart by a distance greater than the width of said screen member, one frame member of said screen member extending parallel to said U-shaped members carrying spring means bearing against one of said cross-leg members when said screen member is received in said fifth pair of track means and being movable to a position wherein said one frame member is closely adjacent said one of said cross-leg members to enable said screen member to be pivoted and removed from said window frame.

9. An integral window unit in accordance with claim 1 wherein said prime window sashes include pin members at their lower ends projecting into said first and second pair of track means and being receivable in slide members, said prime window sashes also including guide members at their upper ends also projecting into said first and second pair of track means, said slide member including rotatable portions in which said pin members are received and said guide members being movable to a position out of said track means whereby said prime windows can be pivoted about an axis at their lower ends when said guide members are moved out of track means.

10. An integral window unit comprising a sill member, a header member and a pair of jamb members interconnected to form a generally rectangular window frame, first, second, third and fourth pairs of track means, one track means in each pair being located in one of said jamb members so that the first and second pair of track means each slideably receive a prime window sash and so that the third and fourth pair of track means each slideably receive a storm window sash, each track means in a pair being offset from the track means in an adjacent pair, each track means in said first and second pair of track means being generally rectangular in cross-section and each track means in said first pair being in overlapping relationship with the adjacent track means in said second pair, a relatively rigid thermal barrier extending about said window sash between said second and third pair of track means, and a fifth pair of track means inwardly and directly adjacent said thermal barrier, each track means in said fifth pair being located in a different jamb member so that said fifth pair of track means slideably receive a screen member, each of said track means in said fifth pair being made of a material acting as a thermal barrier.

* * * * *